United States Patent [19]

Nardelli

[11] 4,405,412

[45] Sep. 20, 1983

[54] REMOVAL OF COPPER CONTAMINATION FROM TIN PLATING BATHS

[75] Inventor: Christy A. Nardelli, Delaware, Ohio

[73] Assignee: Dart Industries Inc., Northbrook, Ill.

[21] Appl. No.: 362,589

[22] Filed: Mar. 29, 1982

[51] Int. Cl.[3] ..... C25D 3/32

[52] U.S. Cl. ..... 204/54 R; 204/120; 204/DIG. 13

[58] Field of Search ..... 204/43 S, 54 R, 120, 204/DIG. 13

[56] References Cited

U.S. PATENT DOCUMENTS

| | | | |
|---|---|---|---|
| 4,168,223 | 9/1979 | Igarashi et al. | 204/54 R |
| 4,187,166 | 2/1980 | Kruper | 204/54 R |
| 4,347,107 | 8/1982 | Teichmann et al. | 204/54 R |

*Primary Examiner*—M. J. Andrews

*Attorney, Agent, or Firm*—Bryant W. Brennan; Leigh B. Taylor

[57] ABSTRACT

A method for removing copper contaminants from acid electroplating baths comprising adding to the bath sodium formaldehyde sulfoxylate. The presence of the sodium formaldehyde sulfoxylate overcomes overall plating haze and low current density dullness due to copper contamination in the acid tin bath.

6 Claims, No Drawings

REMOVAL OF COPPER CONTAMINATION FROM TIN PLATING BATHS

BACKGROUND OF THE INVENTION

A variety of electroplating baths have been disclosed for the electrodeposition of bright tin upon metallic substrates. These baths have been substantially acidic and have been utilized in many industrial applications. Typical of such disclosed baths include those described in U.S. Pat. Nos. 3,361,652; 3,471,379 and 3,875,029.

Many of these aforementioned baths contain surface active agents and the baths aforementioned typically contain a brightener. While these baths have proven generally satisfactory and have been widely utilized in a commercial setting, they are usually deficient in one or more desirable operating characteristics, and the deposits produced thereby frequently fail to provide a balance of characteristics such as smoothness, brightness, adherence, solderability and stability to resist aging, particularly in the presence of copper ions present as contaminants in the acid plating baths.

Therefore, while various of the baths described in the literature are operable with varying degrees of effectiveness, there has remained a need to provide a means for treating a copper-contaminated bath to produce a bath which is again capable of producing smooth adherent deposits exhibiting spectral brightness over a wide current density range.

It has now been determined that by utilizing sodium formaldehyde sulfoxylate as an additive, a copper-contaminated acid tin or tin-metal alloy electroplating bath can be treated to regenerate a bath which is substantially stable and is capable of producing bright, smooth, fine-grained deposits over a wide cathode current density range upon continued electrolysis.

SUMMARY OF THE INVENTION

In accordance with the invention, there is provided a means for treating an aqueous acidic bath for the electrodeposition of tin or tin/metal which has become contaminated by copper comprising adding from about 0.01 to about 10.0 grams per liter of sodium formaldehyde sulfoxylate.

The addition of sodium formaldehyde sulfoxylate to the contaminated acid plating baths according to the present invention eliminates the undesirable overall plating haze and low current density dullness caused by the presence of copper contamination in the acid plating bath. Bright tin or tin-metal deposits can be obtained over a wide current density range upon continued operation of the bath.

DESCRIPTION OF THE PREFERRED EMBODIMENT

The compositions treated in accordance with the present invention exhibit the desired bright plating activity, particularly on copper and copper alloy substrate and are further characterized in that an extended bath life is realized.

The treating method of the present invention is based upon the discovery that the addition of sodium formaldehyde sulfoxylate to an acid electroplating bath will minimize or eliminate the adverse effects of copper contamination on the acid bath.

In a preferred embodiment of the present invention the acid bath which is treated will comprise an aqueous solution of a free acid, stannous or a mixture of stannous and metal ions and sodium formaldehyde sulfoxylate. It is advantageous to include normal brightening agents, and surface active agents can also be included in the bath compositions. These components can be present in an amount of from about 5% to about 40% of free acid; from about 0.1% to about 10% of tin; from about 0.1% of other metal ion; and from about 0.01% to about 10% of sodium formaldehyde sulfoxylate. When present in the composition the brightening agent comprises from about 0.001% to about 10% of the composition and the surface active agent will constitute from about 0.1% to about 8.0%.

The free acid can be sulfuric acid, fluoboric acid or mixtures thereof. Most commonly sulfuric acid will be employed.

Other metals which can be combined with the tin are lead and nickel.

Representative examples of brightening agents which can be employed in the compositions of the present invention are benzaldehyde, cinnamaldehyde and anisaldehyde.

Any of the surface active agents known to the art for use in electroplating baths can be employed. Representative examples are the alkoxylated fatty acid alkylolamides and the alkyl phenoxypolyethoxyethanols.

Other conventional components of tin plating baths can be present in the compositions of the present invention. Thus, there can be included antioxidants and foam suppressors.

The following examples illustrate the invention.

EXAMPLE 1

A bath was prepared by adding 2 ounces per gallon of tin metal to 10 percent by volume of 66° Baume sulfuric acid in 1 gallon of water, 4 percent by volume of ELECTRO-BRITE, a commercial surfactant-brightener mixture, and 150 parts per million of copper in the form of copper sulfate. The Hull cell panel plated at 1 ampere for 5 minutes indicated a hazy and dull plate over the entire range.

ELECTRO-BRITE is a trademark of Dart Industries, Inc.

EXAMPLE 2

Plating tests were carried out in a Hull cell under the same conditions and employing an identical bath to that used in Example 1 except that an additional 4 percent by volume of the surfactant-brightener mixture of Example 1 was employed. The Hull test panel again indicated a hazy and dull plating.

EXAMPLES 3 AND 4

The identical procedure of Example 1 was carried out employing baths to which there had been added, respectively, sodium formaldehyde bisulfite and formaldehyde solution. Again, the test results were unsatisfactory.

EXAMPLE 5

One percent by volume of a 100 grams/liter solution of sodium formaldehyde sulfoxylate was added to the copper-contaminated tin bath of Example 1 with thorough mixing and allowed to stand overnight. The resulting brick red solution was filtered.

The Hull cell panels plated from the thus-treated bath indicated full bright strong platings.

Copper impurity levels were checked by atomic absorption spectroscopy with the following results:

| Additive | Copper Content |
|---|---|
| None | 141 ppm copper |
| 1% sodium formaldehyde sulfoxylate | 33.7 ppm copper |
| 2% sodium formaldehyde sulfoxylate | 3.4 ppm copper |

The results reported above demonstrate that the presence of sodium formaldehyde sulfoxylate significantly reduces the copper contamination in acid tin baths and enables the realization of bright clear panels.

It will be obvious to those skilled in the art that various modifications can be made to the specific embodiments discussed above. All such departures from the foregoing specification are considered to be within the scope of this invention as disclosed in this specification and defined by the appended claims.

What is claimed is:

1. A method for the treatment of copper-contaminated aqueous acid plating baths for the electrodeposition of bright tin comprising adding to said bath which further comprises from about 5% to about 40% of a free acid; and from about 0.1 to about 10 ounces per gallon of stannous ion an additional comprising from about 0.01% to about 1% of sodium formaldehyde sulfoxylate thereby overcoming plating haze and low current density dullness due to copper contamination in the tin bath.

2. A method according to claim 1 wherein the free acid is sulfuric acid.

3. A method according to claim 1 wherein the free acid is fluoboric acid.

4. A method according to claim 1 wherein from about 0.001% to about 10% of a brightening agent is present.

5. A method for the treatment of copper-contaminated aqueous acid plating baths for the electrodeposition of bright tin comprising adding to said bath which further comprises 10% of sulfuric acid, and 2 ounces per gallon of stannous ion, 2% an additional comprising of sodium formaldehyde sulfoxylate thereby overcoming plating haze and low current density dullness due to copper contamination in the tin bath.

6. A method according to claim 5 wherein 4% of a brightening agent is present.

* * * * *

UNITED STATES PATENT AND TRADEMARK OFFICE

CERTIFICATE OF CORRECTION

PATENT NO. : 4,405,412

DATED : September 20, 1983

INVENTOR(S) : Christy Ann Nardelli

It is certified that error appears in the above-identified patent and that said Letters Patent are hereby corrected as shown below:

Column 2, line 6, after "0.1%" 1st occurrence add -- to about 10% --.

Claim 1, line 6 - "additional" should read -- additive -- .

Claim 5, line 5, delete "2%" .

Claim 5, line 5 - "additional" should read -- additive -- .

Claim 5, line 6, after "comprising" add -- 2% -- .

Signed and Sealed this

*Twenty-ninth* Day of *November 1983*

[SEAL]

*Attest:*

GERALD J. MOSSINGHOFF

*Attesting Officer*

*Commissioner of Patents and Trademarks*